US009575443B2

(12) United States Patent
Nakano

(10) Patent No.: US 9,575,443 B2
(45) Date of Patent: Feb. 21, 2017

(54) IMAGE FORMING APPARATUS AND FIXING UNIT ATTACHABLE TO IMAGE FORMING APPARATUS

(71) Applicant: CANON KABUSHIKI KAISHA, Tokyo (JP)

(72) Inventor: Keisuke Nakano, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/155,531

(22) Filed: May 16, 2016

(65) Prior Publication Data

US 2016/0259279 A1 Sep. 8, 2016

Related U.S. Application Data

(63) Continuation of application No. 14/301,215, filed on Jun. 10, 2014, now Pat. No. 9,367,002.

(30) Foreign Application Priority Data

Jun. 14, 2013 (JP) ..... 2013-125715

(51) Int. Cl.
*G03G 15/20* (2006.01)
*G03G 21/16* (2006.01)

(52) U.S. Cl.
CPC ..... *G03G 15/2039* (2013.01); *G03G 15/2017* (2013.01); *G03G 21/1652* (2013.01); *G03G 2215/2035* (2013.01)

(58) Field of Classification Search
CPC ..... G03G 15/2039; G03G 15/2017; G03G 21/1652; G03G 2221/166
See application file for complete search history.

(56) References Cited

U.S. PATENT DOCUMENTS

2012/0148273 A1* 6/2012 Shimura ..... G03G 15/2039 399/33

* cited by examiner

*Primary Examiner* — Erika J Villaluna
(74) *Attorney, Agent, or Firm* — Canon U.S.A., Inc. IP Division

(57) ABSTRACT

The present invention provides an apparatus having a part of a current detecting circuit configured to detect current to a heater in a fixing unit so that a main body of the image forming apparatus may have one configuration for 100 V and 200 V and provides an equal resolution of current detection for an apparatus for 100 V and an apparatus for 200 V.

14 Claims, 10 Drawing Sheets

IMAGE FORMING APPARATUS AND FIXING UNIT ATTACHABLE TO IMAGE FORMING APPARATUS

CROSS-REFERENCE TO RELATED APPLICATIONS

This application is a continuation of U.S. patent application Ser. No. 14/301,215 filed Jun. 10, 2014, which claims the benefit of Japanese Patent Application No. 2013-125715 filed Jun. 14, 2013, all of which are hereby incorporated by reference herein in their entirety.

BACKGROUND OF THE INVENTION

Field of the Invention

The present invention relates to image forming apparatuses applying an electrophotography recording technology and fixing units each attachable to an image forming apparatus.

Description of the Related Art

In some cases, one model of image forming apparatus may be designed to be usable both in a district where commercial power supply voltage is 100 V series (such as 100 V to 127 V) and in a district where it is 200 V series (such as 220 V to 240 V). An image forming apparatus applying an electrophotography recording technology may include a fixing unit configured to heat-fix an unfixed toner image formed on a recording material to the recording material. In order to allow the fixing unit to be usable in districts with different power supply voltages, a resistance value of a heater in the fixing unit may need adjustment based on the power supply voltage in each of the districts. This is because resistance values of heaters not based on power supply voltages may result in variations of amount of heat generated by the heater between the districts.

For setting a resistance value of a heater based on power supply voltage, heaters having different resistance values from each other may be mounted correspondingly in an apparatus for a 100 V district and an apparatus for a 200 V district (as in Japanese Patent Laid-Open No. 9-022224). For example, a heater having a resistance value of 10Ω may be mounted in an apparatus for a 100 V district while a heater having a resistance value of 40Ω may be mounted in an apparatus for a 200 V district. Though this method may require two types of heater, an apparatus for 100 V and an apparatus for 200 V may advantageously be manufactured at low costs.

By the way, the speeds of such image forming apparatuses have been enhanced in recent years, and some apparatuses may include a current detection function configured to detect current fed to the heater to support such increased speeds of the image forming apparatus. The current detection function may detect current fed to the heater and thus is usable for applications such as monitoring for prevention of supply of excessive power to the heater.

The ranges of values of current fed to heaters may be different between an apparatus for 100 V and an apparatus for 200 V as described above. For example, when an apparatus including a heater having a resistance value of 10Ω for 100 V is used by connecting to 100 V power supply voltage, the power consumption may be equal to 1000 W at a maximum, and the range of current values fed to the heater is equal to 0 to 10 A. When an apparatus including a heater having a resistance value of 40Ω for 200 V is used by connecting to power supply voltage 200 V, the power consumption may be equal to 1000 W at a maximum, and the range of current values fed to the heater (which will be called a heater current value) is equal to 0 to 5 A.

The ranges of heater current values in an apparatus for 100 V and the range of heater current values in an apparatus for 200 V are different. Among image forming apparatuses having a current detection function, such different ranges of heater current values may result in different resolutions of the current detection and thus result in different accuracies of the current detection between the apparatus for 100 V and the apparatus for 200 V.

Accordingly, it may be considered that an element (such as a resistance element) for prevention of such a difference in resolution for current detection between an apparatus for 100 V and an apparatus for 200 V may be attached to a main body of the apparatus for 100 V only while not attaching to a main body of the apparatus for 200 V.

However, in order to manufacture an apparatus for 100 V and an apparatus for 200 V, not only two types of fixing unit for 100 V and 200 V may be required therein, but also two types of apparatus main bodies may be required for 100 V and 200 V. This may complicate unit management during the manufacturing process and may thus increase the manufacturing costs.

SUMMARY OF THE INVENTION

The present invention provides an image forming apparatus and a fixing unit attachable to an image forming apparatus, which may achieve reduced variations of accuracy of current detection between an apparatus for 100 V and an apparatus for 200 V and reduced manufacturing costs.

According to another aspect of the present invention, there is provided an image forming apparatus including:

an apparatus main body to which a first fixing unit having a heater corresponding to a 100 V series commercial power supply and a second fixing unit having a heater corresponding to a 200 V series commercial power supply are exchangeably attachable; and a current detecting circuit provided in the apparatus main body, the current detecting circuit detecting current fed to the first fixing unit or the second fixing unit attached to the apparatus main body, wherein an unfixed image formed on a recording material is fixed to the recording material with heat from a heater in the first fixing unit or the second fixing unit attached to the apparatus main body, wherein at least one of the first fixing unit and the second fixing unit has a part of the current detecting circuit, and wherein the apparatus main body has a connector configured to connect the part of the current detecting circuit and the current detecting circuit provided in the apparatus main body.

According to another aspect of the present invention, there is provided an image forming apparatus including:

a fixing unit having a heater configured to generate heat with power supplied from a commercial power supply, the fixing unit being configured to fix an unfixed image formed on a recording material to the recording material with heat from the heater;

a current detecting circuit configured to detect current fed to the heater; and an apparatus main body configured to accommodate the current detecting circuit, wherein the fixing unit is attachable to the apparatus main body, and wherein a part of the current detecting circuit is provided in the fixing unit.

According to another aspect of the present invention, there is provided a fixing unit including:

a heater configured to generate heat with power supplied from a commercial power supply, wherein the image forming apparatus has a current detecting circuit configured to detect current fed to the heater, and wherein the fixing unit has a part of the current detecting circuit.

Further features of the present invention will become apparent from the following description of exemplary embodiments with reference to the attached drawings.

BRIEF DESCRIPTION OF THE DRAWINGS

FIG. 3 is a relation diagram between current fed to a heater, duty ratio, and so on.

FIG. 8 is a relation diagram of current fed to a heater, duty ratio and so on.

DESCRIPTION OF THE EMBODIMENTS

First Exemplary Embodiment

Figure 10:
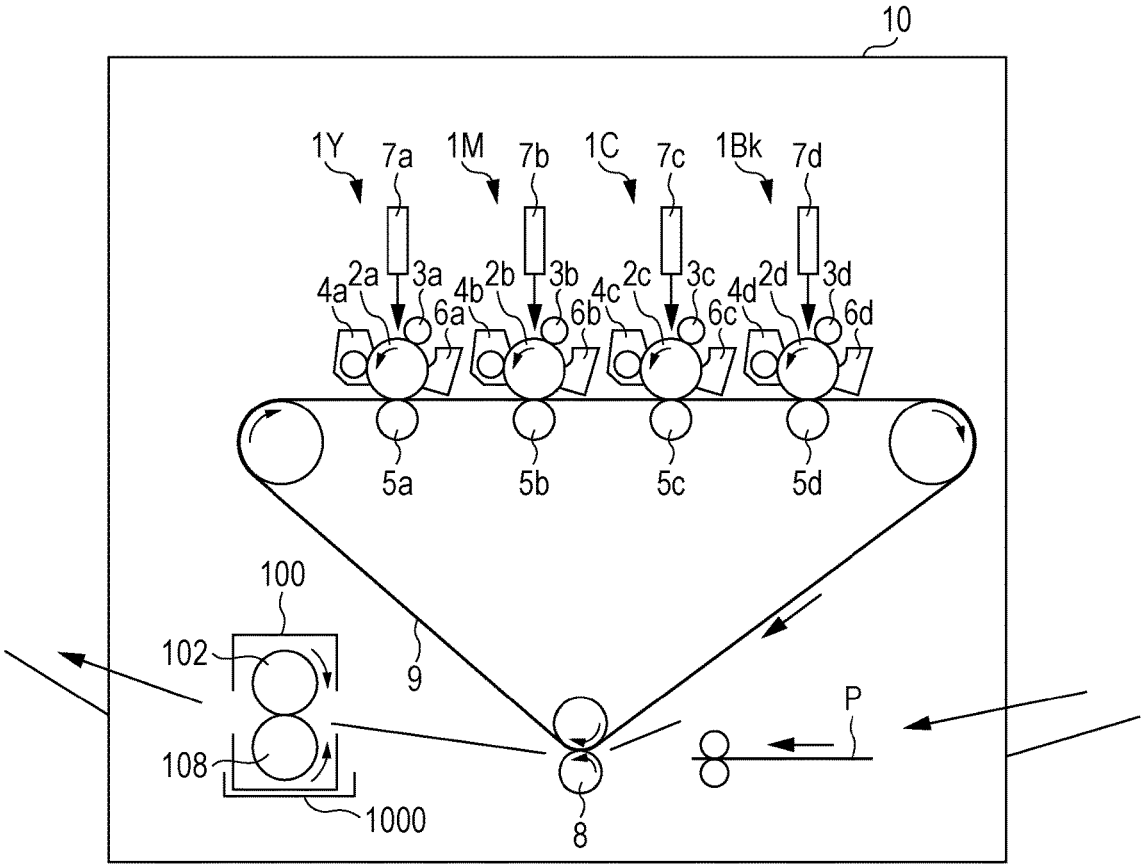
FIG. 10 is a cross section view of an image forming apparatus.

FIG. 10 is a cross section view of a full-color image forming apparatus 10 applying an electrophotography recording technology. An image forming unit configured to form an unfixed toner image on a recording material P has four image forming stations (1Y, 1M, 1C, 1Bk). Each of the image forming stations has a photosensitive member 2 (2*a*, 2*b*, 2*c*, 2*d*), a charging member 3 (3*a*, 3*b*, 3*c*, 3*d*) configured to charge the photosensitive member, and a laser scanner 7 (7*a*, 7*b*, 7*c*, 7*d*) configured to form an electrostatic latent image based on image information on the charged photosensitive member. Each of the image forming stations further has a developing device 4 (4*a*, 4*b*, 4*c*, 4*d*) configured to develop an electrostatic latent image by using toner, a transferring member 5 (5*a*, 5*b*, 5*c*, 5*d*) configured to transfer toner image from the photosensitive member to an intermediate transfer belt 9, and a cleaner 6 (6*a*, 6*b*, 6*c*, 6*d*) configured to clean the photosensitive member. The image forming unit further includes the intermediate transfer belt 9 and a secondary transferring member 8 configured to transfer a toner image from the belt 9 to the recording material P, in addition to the four image forming stations. Because the operations of the image forming unit are well known, the detail description will be omitted. The recording material P to which an unfixed toner image is transferred in the image forming unit is passed to a fixing unit 100, undergoes a fixing process and then is discharged externally to the apparatus. The fixing unit 100 is detachable from an attachment 1000 provided in an apparatus main body 10.

Figure 1:
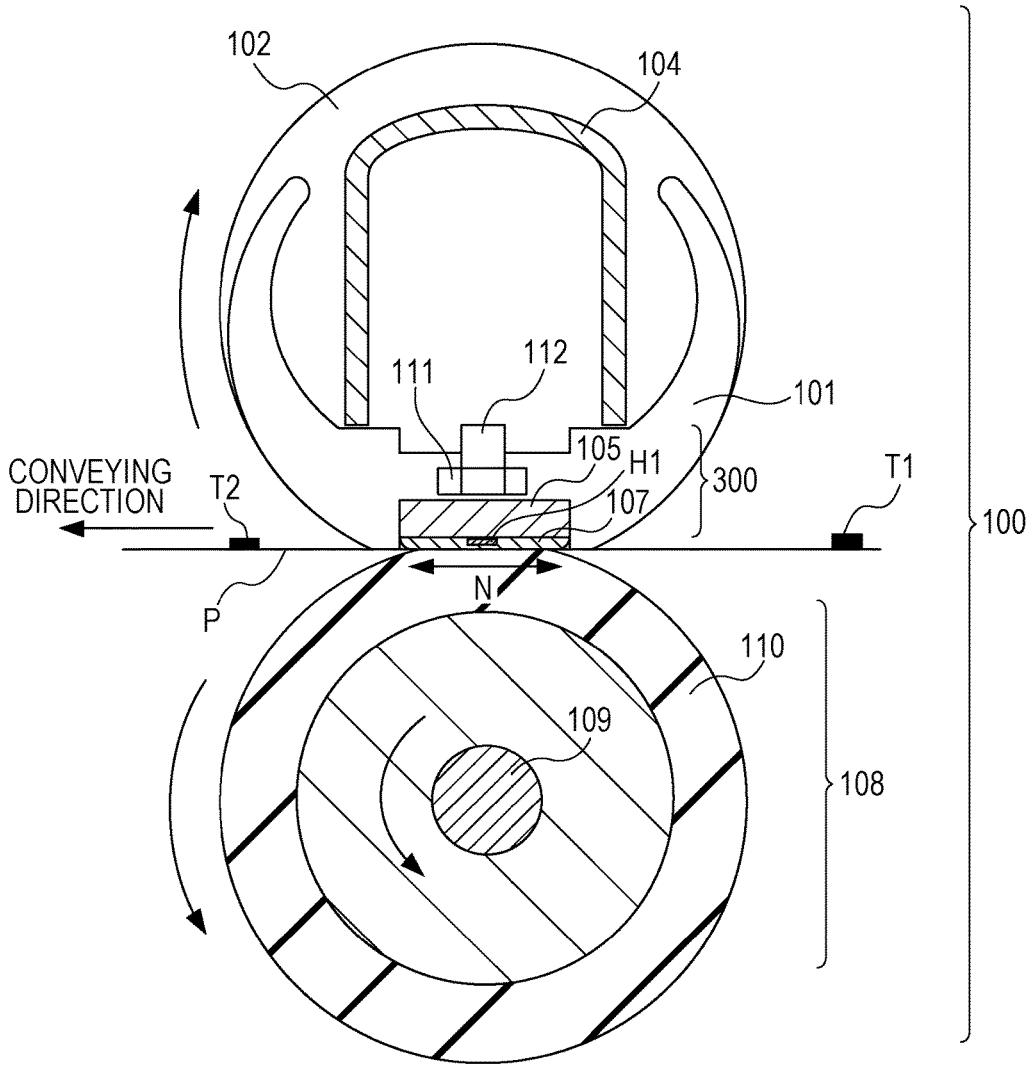
FIG. 1 is a cross section view of a fixing unit.

FIG. 1 is a cross section view of the fixing unit 100 having a heater 300 configured to generate heat with power supplied from commercial power supply and fix an unfixed toner image (unfixed image) T1 formed on the recording material P to the recording material P by using heat from the heater 300.

The fixing unit 100 has a tubular film 102, the heater 300 in contact with an inner surface of the film 102, and a roller (nip portion forming member) 108 configured to form a fixing nip portion N through the film 102 together with the heater 300. A base layer of the film is formed of a material such as polyimide or other heat-resistant resin or stainless or other metal. The roller 108 has a shaft 109 formed of a material such as iron and aluminum and an elastic layer 110 formed of a material such as silicone rubber. The heater 300 is held by a holding member 101 formed of a heat-resistant resin. The holding member 101 has a guiding function configured to guide rotation of the film 102. The roller 108 rotated in the direction indicated by the arrows in FIG. 1 by power supplied from a motor, not illustrated. The film 102 rotates by following the rotation of the roller 108.

The heater 300 has a heater substrate 105 formed of ceramic, a heating element H1 formed on a heater substrate 105, and an insulating surface protecting layer 107 (of glass according to this exemplary embodiment) which covers the heating element H1. A temperature detection element 111 such as a thermistor is abutted on a paper feeding region of a back surface of the heater substrate 105 for usable minimum size paper (an envelope DL: 110 mm wide in the present example) set to the image forming apparatus. The power to be supplied from a commercial AC power supply to the heater 300 is controlled based on a temperature detected by the temperature detection element 111. The recording material P bearing unfixed toner image T1 is pinched and conveyed by the fixing nip portion N and is heated for fixing. FIG. 1 illustrates a toner image T2 after the fixing process. A safety element 112 such as a thermal switch is also abutted on the back surface of the heater substrate 105. The safety element 112 operates to shut down a feeder (power supply path) to the heater 300 when the temperature of the heater 300 rises abnormally. The safety element 112 is also abutted on the paper feeding region for minimum size paper, like the temperature detection element 111. A metallic stay 104 applies pressure from a spring, not illustrated, to the holding member 101.

Figure 2:
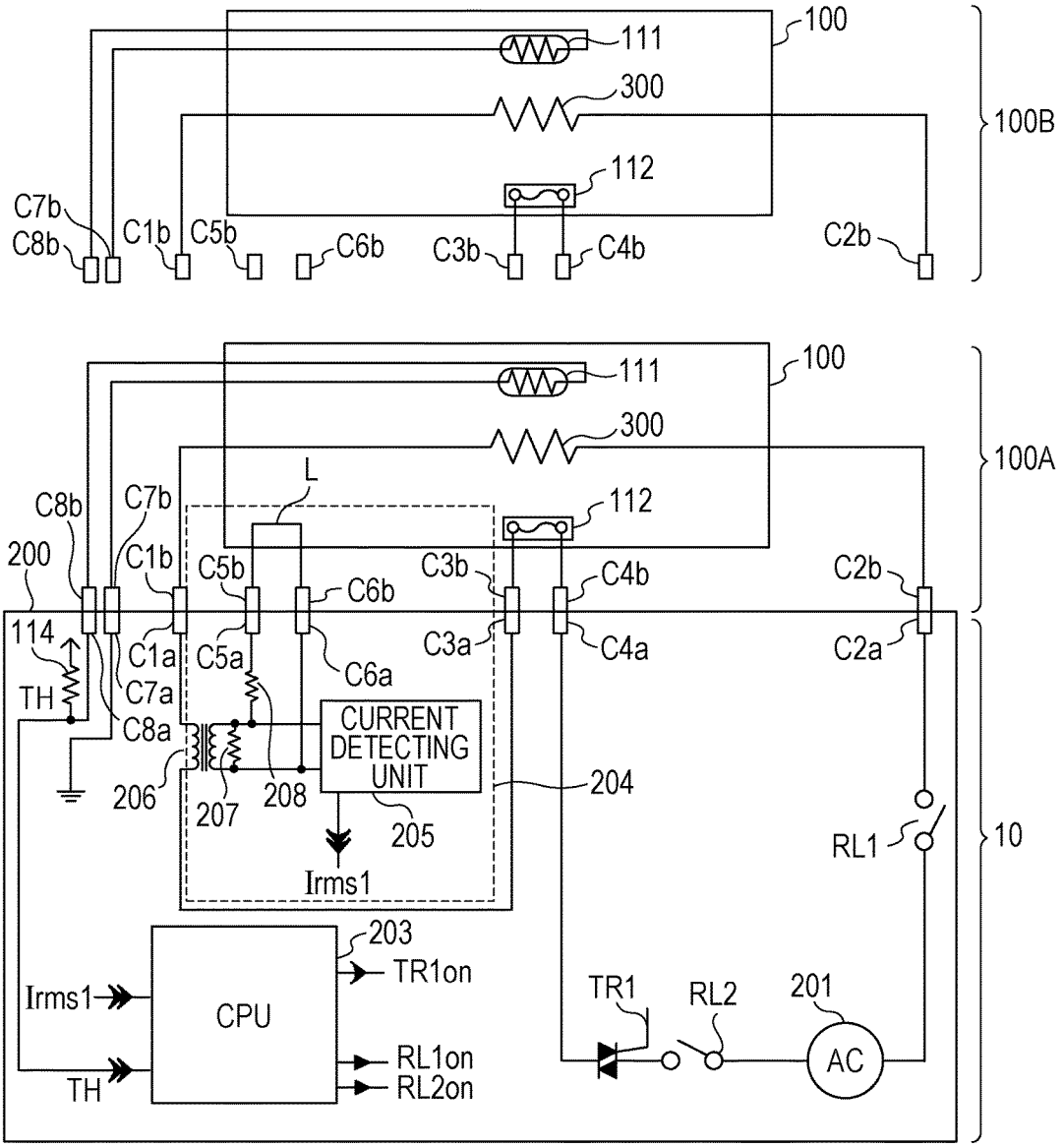
FIG. 2 illustrates a heater control circuit according to a first exemplary embodiment.

FIG. 2 illustrates the fixing unit 100 and a heater control circuit 200. The heater control circuit 200 is provided within the apparatus main body 10. A fixing unit (first fixing unit) 100A and a fixing unit (second fixing unit) 100B may be exchangeably attached to the apparatus main body 10. The fixing unit 100A has a heater corresponding to a 100 V series commercial power supply. The fixing unit 100B has a heater corresponding to a 200 V series commercial power supply. The apparatus main body 10 has an identical configuration for districts of 100 V series and districts of 200 V series.

Connectors C1 (C1*a*+C1*b*), C2 (C2*a*+C2*b*), C3 (C3*a*+C3*b*), and C4 (C4*a*+C4*b*) connect the control circuit 200 and the heater 300 (forming a power supply path to the heater). Connectors C7 (C7*a*+C7*b*) and C8 (C8*a*+C8*b*) connect the control circuit 200 and the temperature detection element 111. FIG. 1 further illustrates a commercial AC power supply 201. Relays RL1 and RL2 switch the power application/shut down to the heater 300. FIG. 2 illustrates a state (shut down state) of the relays in a case where the image forming apparatus has a power off state. The power control over the heater 300 may be implemented by bringing the relays RL1 and RL2 into a conductive state for power application/shut down to a triac TR1 (semiconductor drive element). The triac TR1 operates in response to a heater drive signal TR1on from a CPU 203. A temperature is detected by the temperature detection element 111 as a partial pressure of a pull-up electrical resistance 114 and is input as a TH signal to the CPU 203. The CPU 203 calculates power to be supplied by using PI control, for example, based on the temperature detected by the temperature detection element 111 and a set temperature (control target temperature) of the heater 300. A heater drive signal TR1on indicative of a phase angle based on the calculated power is transmitted to the triac TR1 to control the triac TR1. Under such control, the heater 300 may be kept at a set temperature during a fixing process. When a temperature detected by the temperature detection element 111 is higher than a predetermined upper limit temperature, an abnormal temperature rise is judged, and the relays RL1 and RL2 are shut down.

Next, a current detecting circuit 204 will be described. The current detecting circuit 204 of this exemplary embodiment is provided for monitoring to prevent supply of an excessive amount of power to the heater 300 and is accommodated in the apparatus main body.

The current detecting circuit 204 is provided in the power supply path to the heater 300, as illustrated in FIG. 2. The current detecting circuit 204 passes the current flowing through the primary side (power supply path to the heater) to the secondary side through a current transformer 206, and an electrical resistance 207 performs I-V conversion (current-voltage conversion) thereon, and the result is input to a current detecting unit 205. The current detecting unit 205 has a multiplier internally and outputs a signal Irms1 indicative of a square value of a current effective value to the CPU 203 for each one cycle of a commercial AC waveform. The current detecting unit 205 may be an IC (Integrated Circuit) chip, for example. The CPU 203 detects a current effective value for each one cycle of a commercial AC waveform from the signal Irms1. The current detecting circuit 204 may have a configuration as disclosed in Japanese Patent No. 4920985, for example. Outputting a square value of a current effective value as described above advantageously allows easy calculation of the amount of power to be fed to the heater 300.

The CPU 203 uses the signal Irms1 to limit the power to be supplied to the heater 300 to 1000 W or lower, for example. In an apparatus for 100 V to which the first fixing unit mounting a heater having a resistance value of 10Ω is connected, power higher than 1000 W may be detected from current higher than 10 A flowing through the power supply path to the heater. In other words, the upper limit Ilimit of current may be set to 10 A for an image forming apparatus for 100 V to which the first fixing unit is connected. In an apparatus for 200 V to which the second fixing unit mounting a heater having a resistance value of 40Ω is connected, current higher than 5 A flowing through the power supply path to the heater maybe detected. In other words, the upper limit Ilimit of current may be set to 5 A for an image forming apparatus for 200 V to which the second fixing unit is connected.

According to this embodiment, for controlling power to be supplied to the heater to a predetermined amount of power or lower by using a current detection result, the following method is applied.

First, power is supplied to the heater 300 at a predetermined fixed duty ratio D1. A TR1on signal having a phase angle α1 corresponding to the fixed duty ratio D1 is transmitted from the CPU 203 to the triac TR1, and the triac TR1 is turned on with the phase angle α1. Thus, current turned on with the phase angle α1 is fed to the heater 300 (see FIG. 3). A current effective value I1 is detected from a signal Irms1 output from the current detecting unit 205 when power is supplied at the fixed duty ratio D1. From the detected current effective value I1, the fixed duty ratio D1, and a preset current limit Ilimit, the CPU 203 calculates a power duty ratio Dlimit that is an upper limit for allowing power supply to the heater by using the following expression (1):

$$D\text{limit}=(I\text{limit}/I1)^2\times D1 \quad (1)$$

Figure 3:
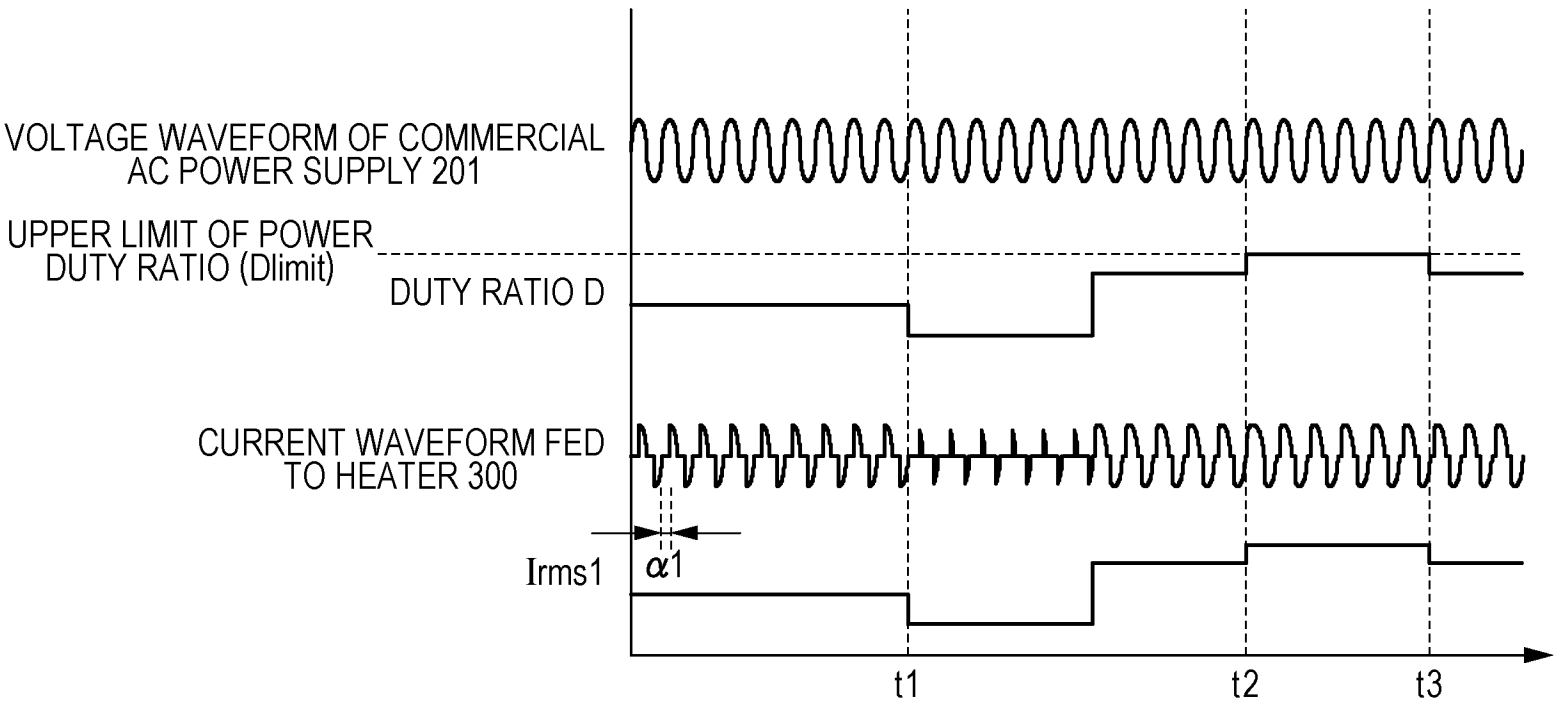

FIG. 3 illustrates a relationship among a voltage waveform of the commercial AC power supply 201, an upper limit of power duty ratio Dlimit, a duty ratio D of power to be actually supplied to the heater, a waveform of current fed to the heater 300, and a square value Irms1 of the current effective value. In a period to a time t1, power is supplied to the heater 300 at the fixed duty ratio D1, and the upper limit of power duty ratio Dlimit is calculated. From the time t1, control for keeping the heater 300 at a set temperature starts. The control supplies power at a duty ratio D calculated based on a comparison result between a temperature detected by the temperature detection element 111 and a set temperature (control target temperature), as described above. FIG. 3 illustrates a case where the duty ratio D calculated based on a comparison result between the temperature detected by the temperature detection element 111 and the set temperature (control target temperature) is equal to or higher than the upper limit of power duty ratio Dlimit during a period from a time t2 to a time t3. For example, this may be a case where the power required for keeping the heater at the set temperature is equal to 1100 W. In this case, the duty ratio D for power to be actually supplied is limited to the upper limit of power duty ratio Dlimit. This control may prevent the supply power from exceeding 1000 W. At the time t3, when the duty ratio D calculated based on a comparison result between the temperature detected by the temperature detection element 111 and the set temperature is lower than the upper limit of power duty ratio Dlimit, power is supplied at the calculated duty ratio D. As being understood from FIG. 2, the square value Irms1 of the current effective value has duty ratio D are identical in behavior.

Figure 4A:
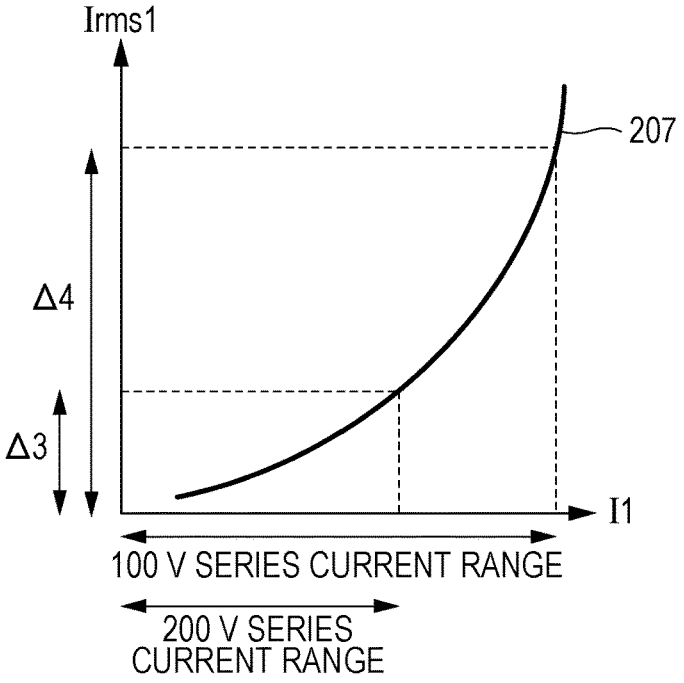
FIGS. 4A and 4B illustrate relationships between effective value of current fed to a heater and square value of a current effective value to be output to a CPU.

FIG. 4A illustrates a relationship between the current effective value I1 of current fed to the primary side of the current transformer 206 and the square value Irms1 of the current effective value output to the CPU 203. As illustrated in FIG. 4A, the resolution for Irms1 is higher in a region having higher I1 while the resolution for Irms is lower in a region having lower I1, influencing on the accuracy of detection of the current effective value. As described above, the range (0 to 10 A) of the heater current value in an apparatus for 100 V and the range (0 to 5 A) of the heater current value in an apparatus for 200 V are different. Thus, the resolution for current detection is lower in an apparatus for 200 V than that in an apparatus for 100 V.

The electrical resistance 207 is an electrical resistance (resistance element) configured to perform I-V conversion. Assuming an equal magnitude of the current effective value I1, as the value of the electrical resistance 207 decreases, the square value Irms1 of the current effective value against the current effective value I1 decreases. In other words, in an apparatus for 200 V, the resistance value of the electrical resistance 207 may be increased to increase the square value Irms1 of the current effective value against the current effective value I1. In an apparatus for 100 V, the square value Irms1 of the current effective value may be kept within an allowable input voltage range of the CPU 203 by reducing the electrical resistance 207 to prevent an excessive increase of the square value Irms1 of the current effective value against the current effective value I1.

To keep equal current detection performance between an apparatus for 100 V and an apparatus for 200 V, the resistance value of the electrical resistance which performs I-V conversion may be required to change. However, attaching the electrical resistances 207 having different values to a main body of an apparatus for 100 V and a main body of an apparatus for 200 V may result in different configurations between the main body of the apparatus for 100 V and the main body of the apparatus for 200 V. This may require not only two types of fixing unit for 100 V and 200 V but also two types of apparatus main bodies for 100 V and 200 V. Therefore, the unit management may be more complicated during the production process.

According to this exemplary embodiment, a part (L illustrated in FIG. 2) of the current detecting circuit is provided in the fixing unit. Connectors C5*a* and C6*a* in FIG. 2 are provided for switching the parallel connection through the fixing unit 100 between a plurality of resistance elements of the electrical resistance 207 and electrical resistance 208 which perform I-V conversion. In other words, the connectors C5*a* and C6*a* are provided for connecting the part (L in FIG. 2) of the current detecting circuit provided in the fixing unit to the current detecting circuit provided in the apparatus main body. The connectors C5*a* and C6*a* are provided in the apparatus main body. The fixing unit includes connectors C5*b* and C6*b* which connect the connectors C5*a* and C6*a*. The part L of the current detecting circuit is provided in a first fixing unit 100A for 100 V. When the connectors C5*b* and C6*b* in the fixing unit for 100 V is connected to the connectors C5*a* and C6*a* in the apparatus main body, a circuit through the electrical resistance 208 is formed, and the electrical resistance 207 and the electrical resistance 208 are connected in parallel, resulting in a lower synthesized resistance value. On the other hand, a second fixing unit 100B for 200 V does not have the part L of the current detecting circuit. Alternatively, the second fixing unit may be implemented by connecting a resistance element having a sufficiently high value against the electrical resistance 207 to the electrical resistance 207 in parallel so that the influence on the electrical resistance 208 may be suppressed, which is equivalent to the I-V conversion performed by the electrical resistance 207 only. Selecting the values of the electrical resistance 207 and electrical resistance 208 based on commercial power supply voltage may allow generation of Irms1 that fits to power supply voltage by changing the gain of the I-V conversion for each power supply voltage. According to this exemplary embodiment, the second fixing unit 100B for 200 V may not necessarily include the part L of the current detecting circuit, as described above. In this case, the fixing-unit side connectors C5*b* and C6*b* may not be provided in the second fixing unit but may be in the first fixing unit only to connect to the connectors C5*a* and C6*a* in the apparatus main body. Therefore, a part of the current detecting circuit may be provided in at least one of the first fixing unit and the second fixing unit. In the image forming apparatus of this embodiment, the configuration of the current detecting circuit may vary in accordance with the fixing unit to be attached.

Figure 4B:
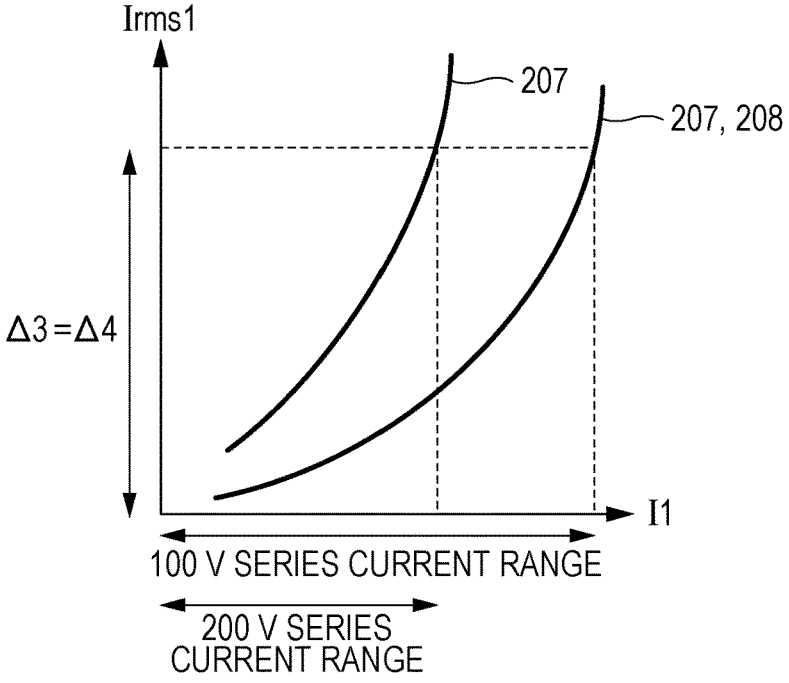

FIG. 4B illustrates a relationship between a current effective value I1 and the square value Irms1 of the current effective value when the electrical resistance for I-V conversion is adjusted in accordance with power supply voltage. Referring to FIG. 4B, the resistance value of the electrical resistance 207 exhibiting the characteristic illustrated in FIG. 4A is increased to improve the resolution of current detection in an apparatus for 200 V. However, a high resistance value of the electrical resistance 207 may result in an excessively high value of Irms1 against I1 in an apparatus for 100 V beyond the allowable input voltage range of the CPU 203. Accordingly, a part L of a circuit for parallel connection between the electrical resistance 207 and the electrical resistance 208 is provided in the fixing unit for 100 V for reducing the synthesized electrical resistance of the electrical resistances which perform IV conversion. This may achieve an improved resolution of current detection in the apparatus for 200 V and an equal resolution of current detection ($\Delta 3=\Delta 4$) in the apparatus for 100 V and the apparatus for 200 V.

According to this exemplary embodiment, two types of fixing unit for 100 V and 200 V may only be required but the apparatus main body 10 may have an identical configuration both for 100 V and 200 V. This may simplify the unit management during the production process and may reduce the production costs. Furthermore, there may be provided an image forming apparatus and a fixing unit attachable to an image forming apparatus, which may exhibit a small difference in accuracy of current detection between an apparatus for 100 V and an apparatus for 200 V and may be produced at reduced costs. For achieving this, a part of the current detecting circuit may be provided in at least one of the first fixing unit and the second fixing unit. A connector for connecting the part of the current detecting circuit provided in the fixing unit to the current detecting circuit provided in the apparatus main body may be provided in the apparatus main body.

Figure 5:
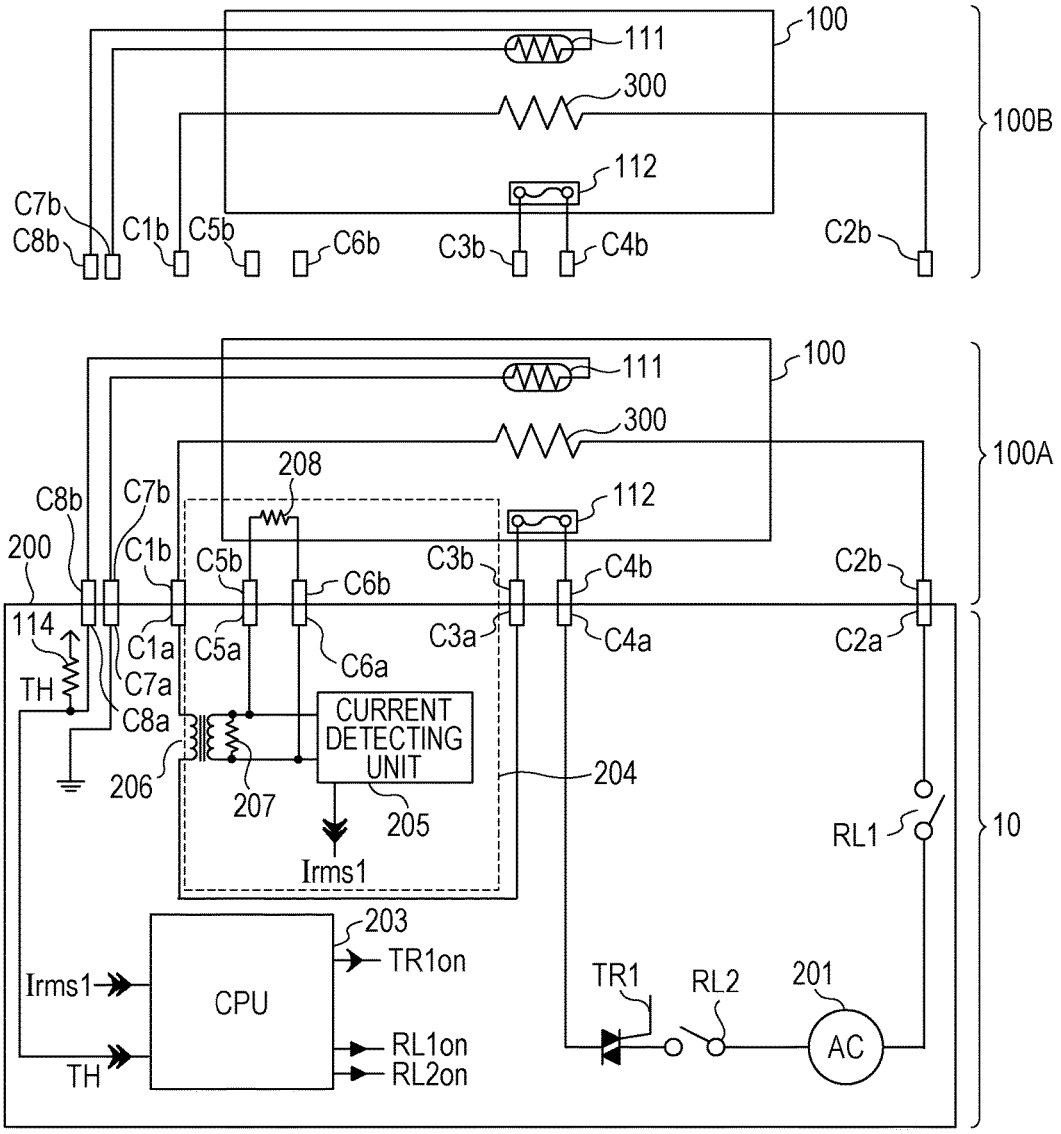
FIG. 5 illustrates a first variation example of the first exemplary embodiment.

FIG. 5 illustrates a first variation example of the first exemplary embodiment. While the electrical resistance 208 is provided in the apparatus main body 10 in the example illustrated in FIG. 2, the electrical resistance 208 is provided in the fixing unit in the example illustrated in FIG. 5.

Figure 6:
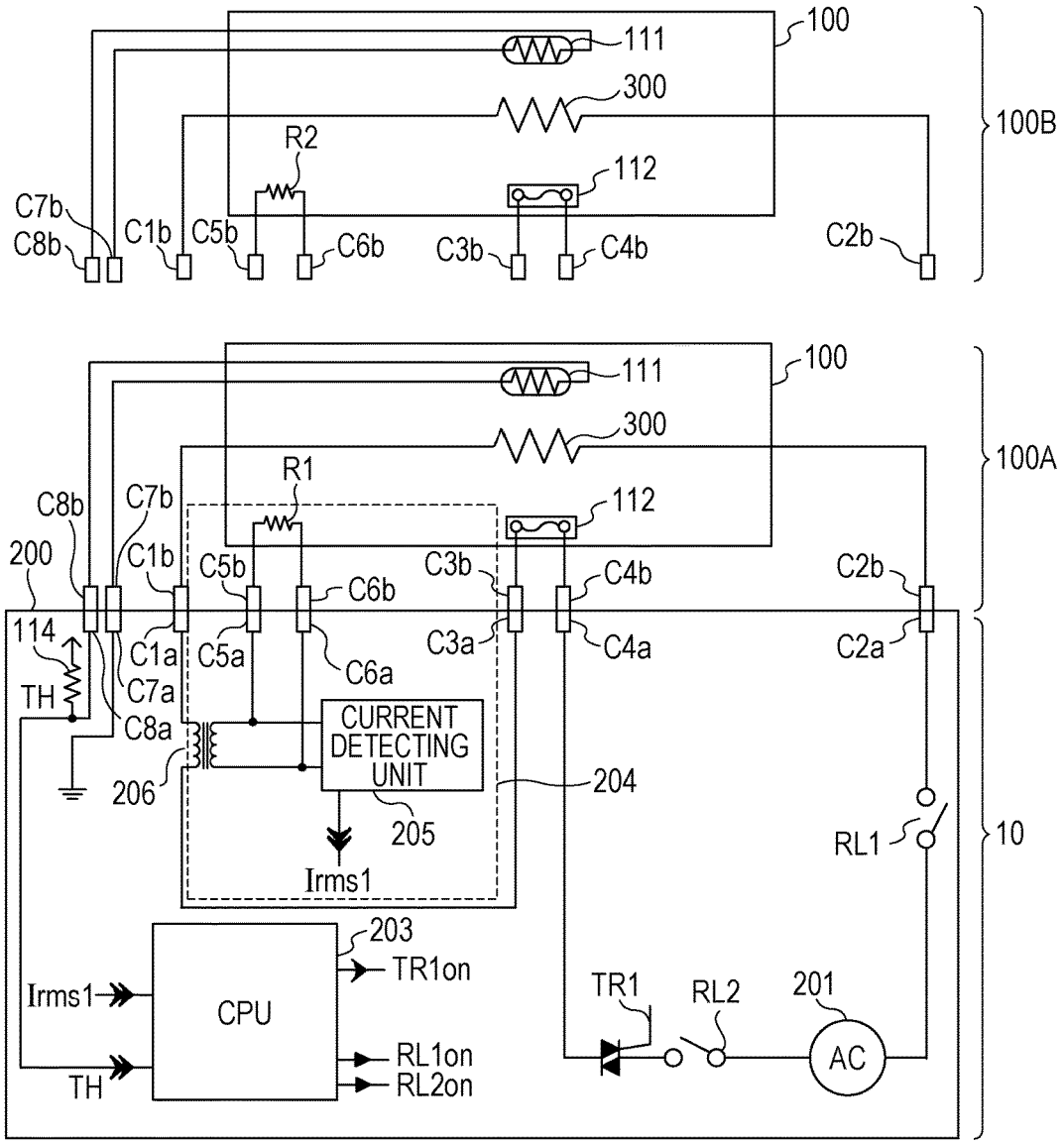
FIG. 6 illustrates a second variation example of the first exemplary embodiment.

FIG. 6 illustrates a second variation example of the first exemplary embodiment. In this example, both of the apparatus for 100 V and the apparatus for 200 V may have only one electrical resistance which performs I-V conversion. The relationship of the resistance value between an electrical resistance R1 and an electrical resistance R2 satisfies R1<R2.

The configurations illustrated in FIG. 5 and FIG. 6 may also achieve an improved resolution of current detection in the apparatus for 200 V and an equal resolution of current detection in the apparatus for 100 V and the apparatus for 200 V. The apparatus main bodies for 100 V and 200 V may have an identical configuration. This may simplify the unit management during the production process and may reduce the production costs.

Second Exemplary Embodiment

Figure 7:
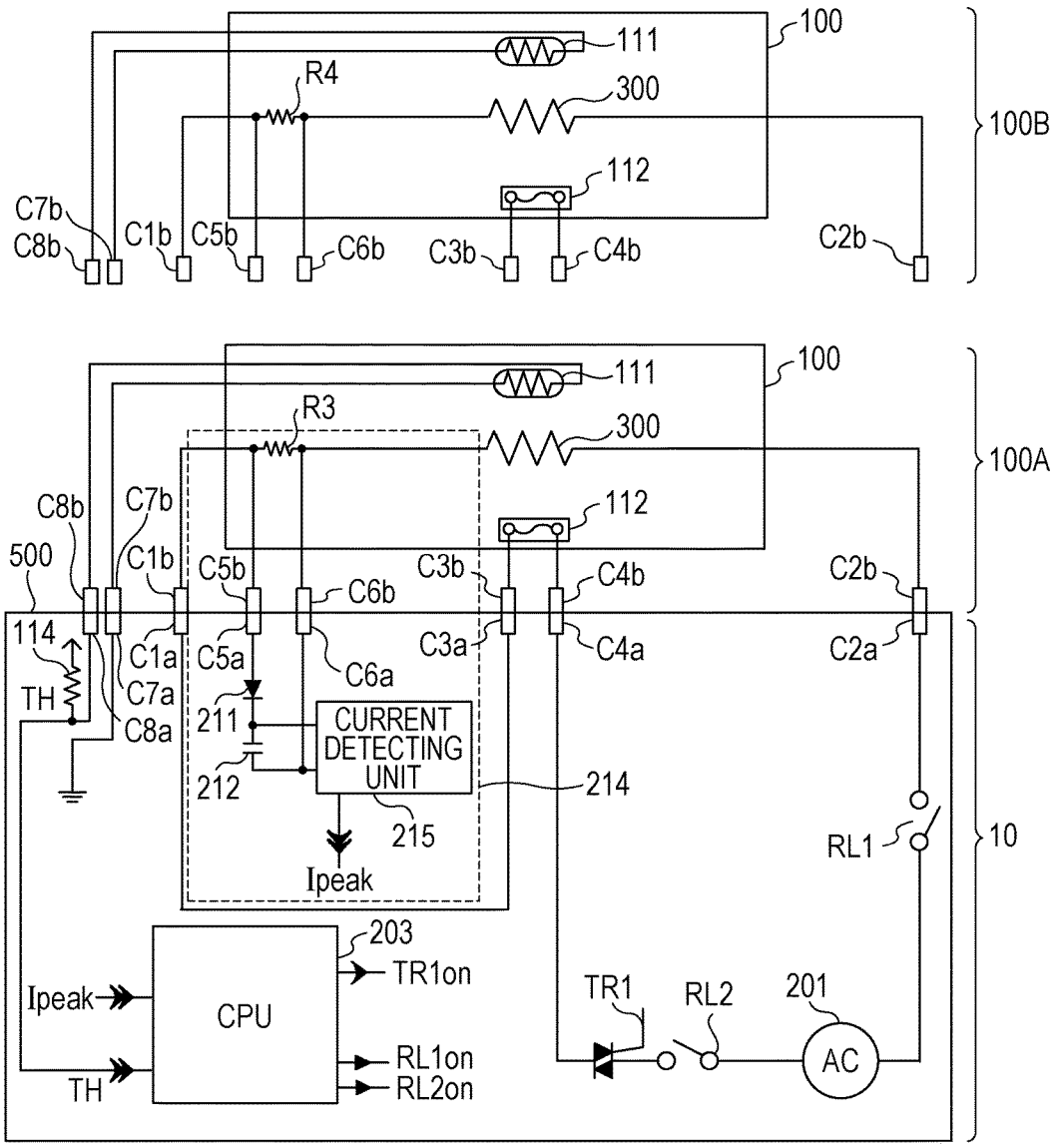
FIG. 7 is a heater control circuit diagram according to a second exemplary embodiment.

FIG. 7 illustrates a heater control circuit 500 according to a second exemplary embodiment. Like reference numerals and signs refer to like parts between the first and second exemplary embodiments.

According to this exemplary embodiment, a current detection electrical resistance R3 (R4) is provided in a power supply path to a heater, instead of the current transformer 206 according to the first exemplary embodiment. The current detection electrical resistance R3 (R4) is provided within a fixing unit. In other words, a part of a current detecting circuit is provided in the fixing unit, like the first exemplary embodiment.

The CPU 203 performs power control based on a peak voltage value occurring in the current detection electrical resistance R3 (R4) and a frequency of generation of voltage. A current value for one wave fed to the heater 300 is calculated from a peak voltage value, and an average current value is calculated from the frequency of generation of voltage. The current detection electrical resistance R4 within the second fixing unit 100B for 200 V may be set to double the value of the current detection electrical resistance R3 within the first fixing unit 100A for 100 V. This may achieve an improved resolution of current detection in the apparatus for 200 V and an equal resolution of current detection in the apparatus for 100 V and the apparatus for 200 V. Furthermore, power control based on commercial power supply voltage may be achieved.

The current detecting circuit 214 according to this embodiment further includes a rectifier diode 211, a capacitor 212, and a current detecting unit 215, in addition to the current detection electrical resistance R3 (R4). The current detection electrical resistance R3 (R4) is provided in the power supply path to the heater 300, as illustrated in FIG. 7. When current is fed to the heater 300, the current detection electrical resistance R3 (R4) performs I-V conversion thereon. A peak of the I-V converted voltage is held by the rectifier diode 211 and capacitor 212. The current detecting unit 215 internally has an amplifier and a converter and outputs a current peak value Ipeak every cycle of a commercial AC waveform. The CPU 203 detects from the peak value Ipeak a peak value of current I2 fed to the heater 300 every cycle of a commercial AC waveform. The CPU 203 further detects the number of times of observation of the peak value Ipeak and calculates a moving average current Iave for eight full waves (eight cycles of an AC waveform), for example, from the current peak value and the frequency. To keep power to be supplied to the heater 300 at a desirable level or lower, power control may be performed such that the moving average current Iave may be equal to or lower than a current limit Ilimit based on the resistance value of the heater 300.

Figure 8:
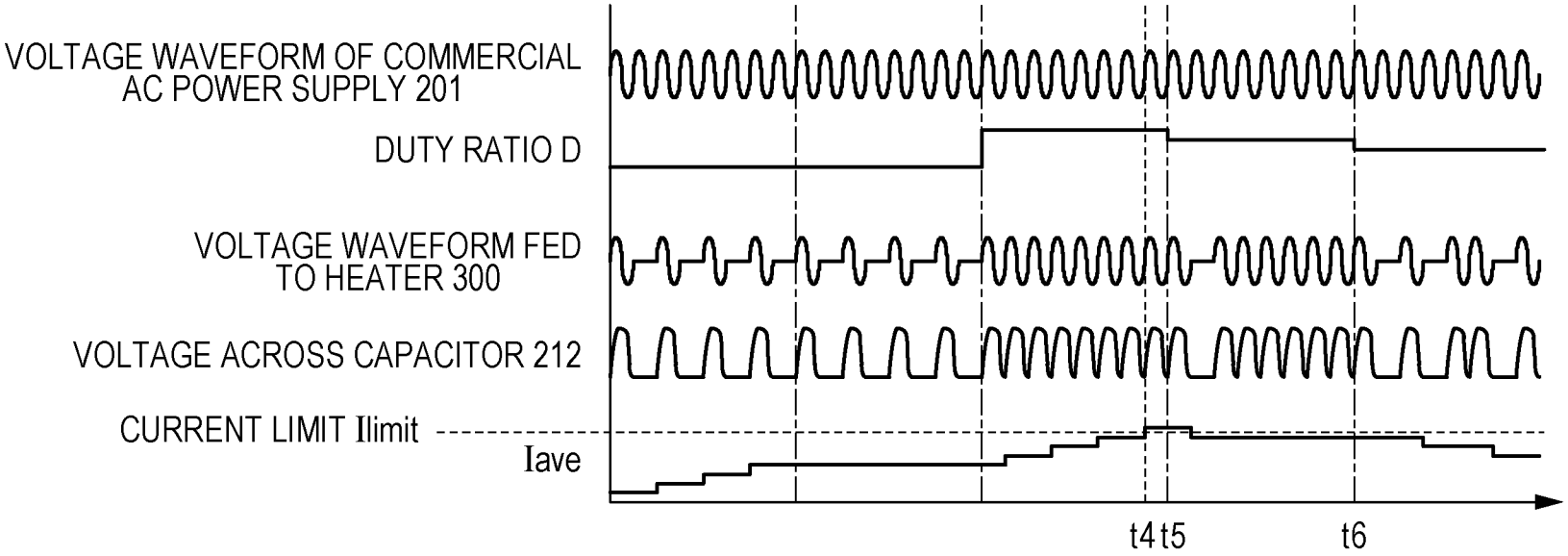

FIG. 8 illustrates a relationship among the voltage waveform of the commercial AC power supply 201, a duty ratio D of power actually supplied to the heater, a current waveform fed to the heater 300, voltage across the capacitor 212, a current limit Ilimit, and a moving average current Iave. According to this exemplary embodiment, waveform control is performed by handling eight full waves as one unit, and a control update time occurs every eight full waves. The moving average current Iave changes in accordance with the voltage across the capacitor 212 and the frequency and is a moving average current value for eight full wave periods. When the voltage of the commercial AC power supply 201 is low, the current fed to the heater 300 is also low. Therefore, the voltage across the capacitor 212 is low, and the Iave value is also low. When the frequency of observation of the Ipeak is low, the Iave value is also low.

At a time t4, it is detected that the moving average current Iave exceeds the current limit Ilimit. At the next control update time t5, the duty ratio D is reduced. Reduction of the duty ratio D allows power equal to or smaller than desirable power to be supplied to the heater 300.

Figure 9A:
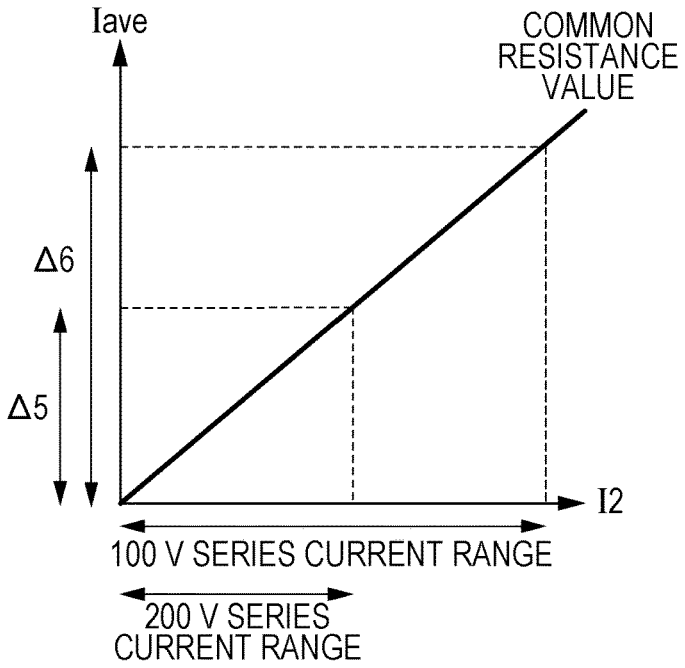
FIGS. 9A and 9B illustrate relationships between effective value of current fed to a heater and moving average current to be output to a CPU.
Figure 9B:
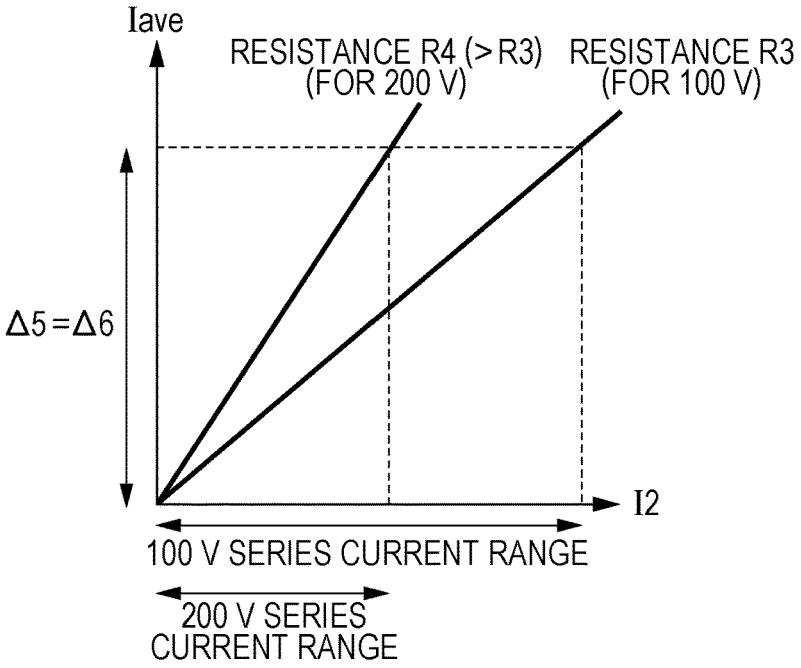

FIG. 9A illustrates a relationship between a current value I2 fed to the heater 300 and the moving average current Iave output to the CPU 203. As illustrated in FIG. 9A, the current detection electrical resistance with a wider current range for an apparatus for 100 V may be used for an apparatus for 200 V so that the Iave resolution 45 may be reduced. On the other hand, as illustrated in FIG. 9B, use of the current detection electrical resistance for an apparatus for 200 V allows current detection with higher accuracy for an apparatus for 200 V.

According to this exemplary embodiment, changing the current detection electrical resistance within the fixing unit 100 in accordance with power supply voltage may achieve current detection with high accuracy, which further allows more stable power control. Fixing units for 100 V and 200 V may only be required but the apparatus main body 10 may have an identical configuration both for 100 V and 200 V. This may simplify the unit management during the production process and may reduce the production costs. According to this exemplary embodiment, a current limit Ilimit is set to change the duty ratio D. However, a target value of supply power to the fixing unit 100 may be predefined, and the duty ratio D may be controlled in accordance with the target value and Iave.

The configuration of the second exemplary embodiment may also achieve an improved resolution of current detection in the apparatus for 200 V and an equal resolution of current detection in the apparatus for 100 V and the apparatus for 200 V. The apparatus main bodies for 100 V and 200 V may have an identical configuration. This may simplify the unit management during the production process and may reduce the production costs.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an apparatus main body to which a first fixing unit having a heater corresponding to a 100 V series commercial power supply and a second fixing unit having a heater corresponding to a 200 V series commercial power supply are exchangeably attachable;

a current detecting unit provided in the apparatus main body, wherein the current detecting unit detects current fed to the heater in the first fixing unit or the second fixing unit attached to the apparatus main body through a current transformer that includes a primary side and a secondary side; and a circuit which connects the current detecting unit with the secondary side of the current transformer, wherein an unfixed image formed on a recording material is fixed to the recording material with heat from the heater in the first fixing unit or the second fixing unit attached to the apparatus main body, wherein at least one of the first fixing unit and the second fixing unit has a part of the circuit provided in the secondary side of the current transformer, and wherein the part of the circuit provided in the at least one of the first and second fixing units is connected with another part of the circuit provided in the secondary side of the current transformer in the apparatus main body when the at least one of the first and second fixing units having the part of the circuit is attached to the apparatus main body.

2. The image forming apparatus according to claim 1, wherein the circuit has an electrical resistance configured to convert current passing through the current transformer to voltage, and a circuit to the current detecting unit through the electrical resistance is formed when the at least one of the first and second fixing units having the part of the circuit is attached to the apparatus main body.

3. The image forming apparatus according to claim 1, wherein the circuit has a plurality of electrical resistances configured to convert current passing through the current transformer to voltage, and a circuit in which the plurality of electrical resistances are connected in parallel is formed when the at least one of the first and second fixing units having the part of the circuit is attached to the apparatus main body.

4. The image forming apparatus according to claim 1, wherein the first fixing unit has a tubular film to be heated by the heater.

5. The image forming apparatus according to claim 4, wherein the heater is in contact with an inner surface of the tubular film.

6. An image forming apparatus comprising:

a fixing unit having a heater configured to generate heat with power supplied from a commercial power supply, wherein the fixing unit is configured to fix an unfixed image formed on a recording material to the recording material with heat from the heater;

a current detecting unit configured to detect current fed to the heater, wherein the current detecting unit detects current fed to the heater through a current transformer that includes a primary side and a secondary side;

an apparatus main body configured to accommodate the current detecting unit and the current transformer; and a circuit which connects the current detecting unit with the secondary side of the current transformer, wherein the fixing unit is attachable to the apparatus main body, wherein the fixing unit has a part of the circuit provided in the secondary side of the current transformer, and wherein the part of the circuit provided in the fixing unit is connected with another part of the circuit provided in the secondary side of the current transformer in the apparatus main body when the fixing unit is attached to the apparatus main body.

7. The image forming apparatus according to claim 6, wherein the circuit has an electrical resistance configured to convert current passing through the current transformer to voltage, and a circuit to the current detecting unit through the electrical resistance is formed when the fixing unit is attached to the apparatus main body.

8. The image forming apparatus according to claim 6, wherein the circuit has a plurality of electrical resistances configured to convert current passing through the current transformer to voltage, and a circuit in which the plurality of electrical resistances are connected in parallel is formed when the fixing unit is attached to the apparatus main body.

9. The image forming apparatus according to claim 6, wherein the fixing unit has a tubular film to be heated by the heater.

10. The image forming apparatus according to claim 9, wherein the heater is in contact with an inner surface of the tubular film.

11. A fixing unit attachable to an image forming apparatus, wherein the fixing unit is configured to fix an unfixed image formed on a recording material to the recording material, the fixing unit comprising:

a heater configured to generate heat with power supplied from a commercial power supply, wherein the image forming apparatus has a current detecting unit configured to detect current fed to the heater through a current transformer that includes a primary side and a secondary side and a circuit which connects the current detecting unit with the secondary side of the current transformer; and a part of the circuit provided in the secondary side of the current transformer, wherein the part of the circuit is connected with another part of the circuit provided in the secondary side of the current transformer in the apparatus main body when the fixing unit is attached to the apparatus main body.

12. The fixing unit according to claim 11, wherein the part of the circuit provided in the fixing unit has a resistance element.

13. The fixing unit according to claim 11, wherein the fixing unit has a tubular film to be heated by the heater.

14. The fixing unit according to claim 13, wherein the heater is in contact with an inner surface of the tubular film.

* * * * *